US006113092A

United States Patent [19]

Greive et al.

[11] Patent Number: 6,113,092

[45] Date of Patent: Sep. 5, 2000

[54] SHEET-FED PRINTING PRESS WITH ROTARY DECOLLATOR

[75] Inventors: Martin Greive, Schoenau, Germany; Urs Fluehmann, Bern, Switzerland; Peter Lehmann, Kirchdorf, Switzerland; Rudolf Luethi, Niederwangen, Switzerland

[73] Assignee: Heidelberger Druckmaschinen AG, Germany

[21] Appl. No.: 08/950,473

[22] Filed: Oct. 15, 1997

[30] Foreign Application Priority Data

| | | | |
|---|---|---|---|
| Oct. 15, 1996 | [DE] | Germany | 196 42 484 |
| Oct. 15, 1996 | [DE] | Germany | 196 42 483 |
| Oct. 15, 1996 | [DE] | Germany | 196 42 485 |

[51] Int. Cl.[7] ..... B65H 3/32

[52] U.S. Cl. ..... 271/113; 271/115; 271/117; 271/121; 271/123; 271/234; 271/250; 271/42

[58] Field of Search ..... 271/10.01, 10.09, 271/10.14, 109, 113, 114, 115, 117, 118, 121, 123, 234, 250, 42

[56] References Cited

U.S. PATENT DOCUMENTS

| | | | |
|---|---|---|---|
| 4,165,870 | 8/1979 | Fallon et al. | 271/113 X |
| 4,319,743 | 3/1982 | Rood . | |
| 4,398,709 | 8/1983 | Janssen . | |
| 4,541,626 | 9/1985 | Millen . | |
| 5,613,671 | 3/1997 | Fricke . | |

FOREIGN PATENT DOCUMENTS

| | | | |
|---|---|---|---|
| 0 099 247 | 11/1987 | European Pat. Off. . | |
| 1 110 182 | 7/1961 | Germany . | |
| 1 155 788 | 10/1963 | Germany . | |
| 1 237 587 | 3/1967 | Germany . | |
| 30 49 600 A1 | 7/1982 | Germany . | |
| 44 10 529 | 9/1995 | Germany . | |
| 4246033 | 9/1992 | Japan | 271/113 |

*Primary Examiner*—David H. Bollinger
*Attorney, Agent, or Firm*—Kenyon & Kenyon

[57] ABSTRACT

A printing machine is described that includes a rotary plate for decollating top sheet from a stack of sheets by turning the top sheet so as to expose a second sheet. The machine also has a clamping finger that tilts into position to hold the second sheet once the top sheet has been turned. The top sheet is then turned back to the original position, aligned with the feed direction.

18 Claims, 5 Drawing Sheets

SHEET-FED PRINTING PRESS WITH ROTARY DECOLLATOR

FIELD OF THE INVENTION

The present invention relates generally to printing presses, and more specifically to sheet-fed printing presses having decollators or sheet feeders.

RELATED TECHNOLOGY

The function of the sheet feeder on a sheet-fed printing press is to provide the printing press with a sequential supply of paper sheets accurately prestacked on a sheet feed plate. To do so, the top sheet of the stack must be decollated. Mainly two types of feeders are used today for sheet-fed offset printing machines, namely single sheet feeders using a suction rod and stream feeders using a suction head.

With a single sheet feeder, the top sheet of the stack is lifted pneumatically at the front edge by a plurality of suction devices attached to a rod and then gripped by feed grippers or conveyor rolls. The latter convey each sheet individually for feed to the printing machine. The single sheet feeder can be adjusted to different grades and weights of stock by adjusting the suction force, by varying the tilt of the suction rod and by the action of air blown against the front edge of the stack. As soon as the decollated sheet has entered the machine, a new sheet can be decollated. Therefore, the decollating process must proceed very rapidly with a single sheet feeder to achieve the desired machine speed.

At higher machine speeds, stream feeders are used, where the sheets are decollated at the rear edge of the stack by a suction head. A stream feeder has various pneumatic separating and dragging suction devices that remove the top sheet and convey it to the feed table together with the other sheets in a staggered stream. In addition, various blasting devices, stripping brushes, stripping plates and sheet hold-down devices are attached to the rear edge of the feeding attachment; the function of these devices is to guarantee trouble-free decollating and smooth, even conveyance of the sheets. During a brief stoppage of the installation, each sheet remains aligned accurately. The printer must accurately adjust the blasting air and the suction air as well as the other auxiliary devices mentioned above to the given type of printing stock.

Thus, suction air and blasting air are needed with the known sheet feed systems, and the higher the operating speeds, the more and more efficient suction and air-blasting equipment is needed, along with an accordingly high air consumption. The suction and blasting equipment generates a great deal of noise, and the periodic on and off of the air streams and the movement of the suction heads in the machine cycle cause vibration that is difficult to control.

SUMMARY OF THE INVENTION

In addition to a device for decollating, the present invention also concerns in particular the alignment of the sheet on the stack of sheets.

An object of the present invention is to create a sheet feeder with a special design for decollating and alignment of the top sheet in the stack, thereby attaining a high operating speed.

The present invention therefore provides a printing machine for printing sheets of paper, etc., which are fed to the printing machine by a sheet feeder, characterized in that the sheet feeder has a turning device (4) which decollates the top sheet (3) on the stack (2) of sheets by turning it.

The present invention also provides a process for operating a printing machine characterized in that the sheet (3) in top position is turned in a first direction A, and the turned sheet (3) partially exposes the sheet beneath it, making it accessible; following the turning A, at least one clamping finger (9) acts on the areas of the sheet beneath the turned sheet (3) that have thus been exposed and made accessible, thereby keeping the lower sheets on the stack; the sheet (3) turned in a first direction A is turned back in a second direction B; a device (10) feeds the sheet (3) by means of the aligning foot (13) in direction B to a stop (5) which serves as the lateral alignment of the sheet (3), and the device (10) conveys the sheet (3) in the direction of sheet feed by means of conveyor foot (11) and advances it to a continued conveyance device (1).

The printing machine advantageously may be arranged so that the stack of sheets is arranged in the direction of sheet feed of the printing machine, the turning device (4) grips the top sheet (3) on the stack (2) of sheets and turns it in a first direction A, and due to the turning, the sheet (3) below the top sheet is partially exposed and accessible.

Further advantageous developments are as follows. At least one clamping finger (9) may be provided which clamps on the sheet (3) below the top sheet of the stack (2) in the area of the exposed and accessible portion. The rotary plate (4) can be moved horizontally and vertically. A device (10) may be provided for lateral alignment of the top sheet (3) is arranged above the sheet (3) and acts from there on the sheet. The device for lateral alignment is also designed as a conveyor device for feeding the top sheet (3) to the printing machine. The device (10) may have an aligning foot (13) and a convey or foot (11), both of which may have a friction lining 12). Moreover, a stop (5) is provided so that the top sheet (3) comes to rest against it for lateral alignment by means of the aligning foot (13). The clamping finger (9) may be designed to taper to a point toward the center of the sheet.

In a first embodiment, the stack of sheets is arranged along the direction of sheet feed. The stack of sheets can be lifted by a lifting mechanism. A rotary plate is provided and is arranged above the stack of sheets. The rotary plate comes into contact with the top sheet of the stack of sheets when the stack is lifted. The rotary plate is secured with a spring action above the stack of sheets, so the stack may optionally raise the rotary plate slightly. The rotary plate as well can be lifted off the stack of sheets.

The function of the rotary plate is to turn the top sheet of the stack of sheets, thereby decollating the top sheet and exposing the second sheet from the top.

Furthermore, another device may be provided to laterally align the top sheet. After lateral alignment, yet another device is responsible for conveyance of the sheet in the direction of sheet feed. However, in an advantageous embodiment of the invention, the lateral alignment and continued conveyance in the direction of sheet feed are implemented in one device. This has the advantage that few operations are performed on the top sheet.

In another advantageous embodiment of the invention, clamping fingers are provided. The function of these clamping fingers is to hold the sheets remaining on the stack and prevent them from turning. The clamping fingers preferably come into play at the locations where the turned sheet at the top exposes the sheets below that and makes them accessible. Multiple clamping fingers may be provided.

To be sure that only one sheet is turned by the rotary plate, a corner separator is provided on at least one corner of the stack of sheets. The function of this corner separator is to keep the stacked sheets aligned. When the top sheet is turned, the corner of the top sheet which is in a corner separator must move past this corner separator while the top sheet is turning. The sheets beneath said top sheet remain in the corner separator, which thus ensures proper turning of the top sheet and prevents two or more sheets from turning at once, which is not desirable.

The clamping fingers are designed so they taper to a point toward the center of the sheet. This has the advantage that when the sheet is turned back again after the first turning, it can easily slip past the clamping fingers.

In a second embodiment, the rotary plate not only turns the top sheet of the stack, thereby decollating and laterally aligning the sheets, but also conveys the sheet in the direction of sheet feed and advanced to the printing elements. The top sheet is decollated and laterally aligned by being turned relative to the stack of sheets in a first direction until one corner of the top sheet has come in contact with a side stop. Then, the sheet is turned in a second direction until another corner of the sheet comes into contact with a stop. Thus at least two corners of the sheet come in contact with stops and thus the sheet is aligned and can be fed to the printing machine in a prealigned and optimized position. Advantageously, the sheet may be laterally aligned and decollated by means of a lifting and aligning device. This device has the rotary plate. This rotary plate comes into contact with the top sheet and performs the lateral alignment. The rotary plate also executes a movement in the direction of the printing machine and thereby conveys the decollated and laterally aligned sheet into a sheet gripping device or another device having the same effect which in turn conveys the sheet into the printing machine. Due to the fact that the sheet is laterally aligned, decollated, and fed to the printing machine using an aligning device, an inexpensive implementation can be achieved. Furthermore, multiple actions on the top sheet of paper are not necessary. Thus both decollating and lateral alignment as well as sheet feed into the printing machine are achieved with only one area of contact on the paper. The rotary plate exerts a holding force on the surface of the top sheet, making it possible to guide the top sheet away from the stack toward a side stop. The holding force or frictional force established between the surface of the sheet and the bottom of the friction plate can be adjusted so that the sheet can be moved away from the stack. In an advantageous embodiment, the friction surface is designed to be just adequate to turn the sheet. As soon as the sheet is in contact with the stops, no further turning of the sheet is desired. For this reason, in an advantageous embodiment the friction surface or holding surface is designed so that the rotary plate can slip over the sheet when the sheet comes to rest against the stops and is held by them. This ensures that the sheet will lie correctly against the stops.

In another advantageous embodiment, the friction surface can be changed during the turning. This can be accomplished by reducing the size of the contact surface or the friction surface between the bottom of the rotary plate and the surface of the sheet of paper during a certain movement, by swiveling parts of the contact surface or friction surface to the inside of the rotary plate. Furthermore, it is also possible to provide the rotary plate with different friction and contact surfaces. For example, it is also conceivable to provide the friction plate with friction linings and brush linings, the friction linings being used during conveyance, and brush linings being used during alignment because they have a low friction and thus permit the plate to continue moving. Then the friction surfaces can again be used for further conveyance of the sheet into the printing machine.

In a third embodiment of the present invention, the sheet stack is preferably positioned in the machine at an angle of 5° to 10° to the actual direction of sheet feed. The stack of paper can be raised by a lifting mechanism. A rotary plate which is provided is mounted above the stack of sheets to turn the top sheet of the stack to achieve decollating. After being turned, the sheet is aligned. In a special embodiment, separators are provided, preferably located at the three corners on the stack of sheets. With the top sheet being decollated by the rotary plate, the corners of the top sheet must bend over these, preferably three, corners of separators. In another advantageous embodiment, slides are provided. Preferably two slides are provided: one slide on one longitudinal side of the sheet and another on the other longitudinal side of the sheet. The slides are mounted on a cross arm which in turn operates firmly attached to the rotary plate. When the rotary plate is turned back after the decollating operation, these slides have the function of returning to the stack any sheets that were turned inadvertently. In another embodiment, the decollated and aligned sheets are conveyed directly into two separate conveyor rolls. These conveyor rolls then directly assume the function of further conveyance of the sheet to the printing elements in the direction of sheet feed. As an alternative, it is also possible to provide opened grippers into which the sheet is fed directly after alignment and decollating. These grippers can then remove the sheet from the stack and send it to the printing element.

The special advantages of this decollating and alignment of the sheet in all of the above embodiments can be seen in the guarantee of reliable separation of sheets even with thin paper. Since air need not be used, this arrangement also yields an enormous noise reduction. In principle, this apparatus is also suitable for all paper weights. i.e., very thick paper in addition to very thin paper. This sheet feeder is very inexpensive to manufacture.

Another special advantage is that the sheet can be aligned during and simultaneously with the decollating operation.

A stack height query can also be implemented very easily by using the height of the rotary plate as the starting basis for the stack height calculation.

The sheet feeder can also be operated very inexpensively because it is not necessary to use suction air or blast air.

The pressure applied by the rotary plate may be adjustable. Different paper stocks and paper weights can be taken into account through the required setting of the pressure, and functionality of the sheet feeder can also be guaranteed even with different materials through the pressure applied.

BRIEF DESCRIPTION OF THE DRAWINGS

Additional features and advantages of the present invention are derived from the figures, in which.

DETAILED DESCRIPTION

Figure 1:
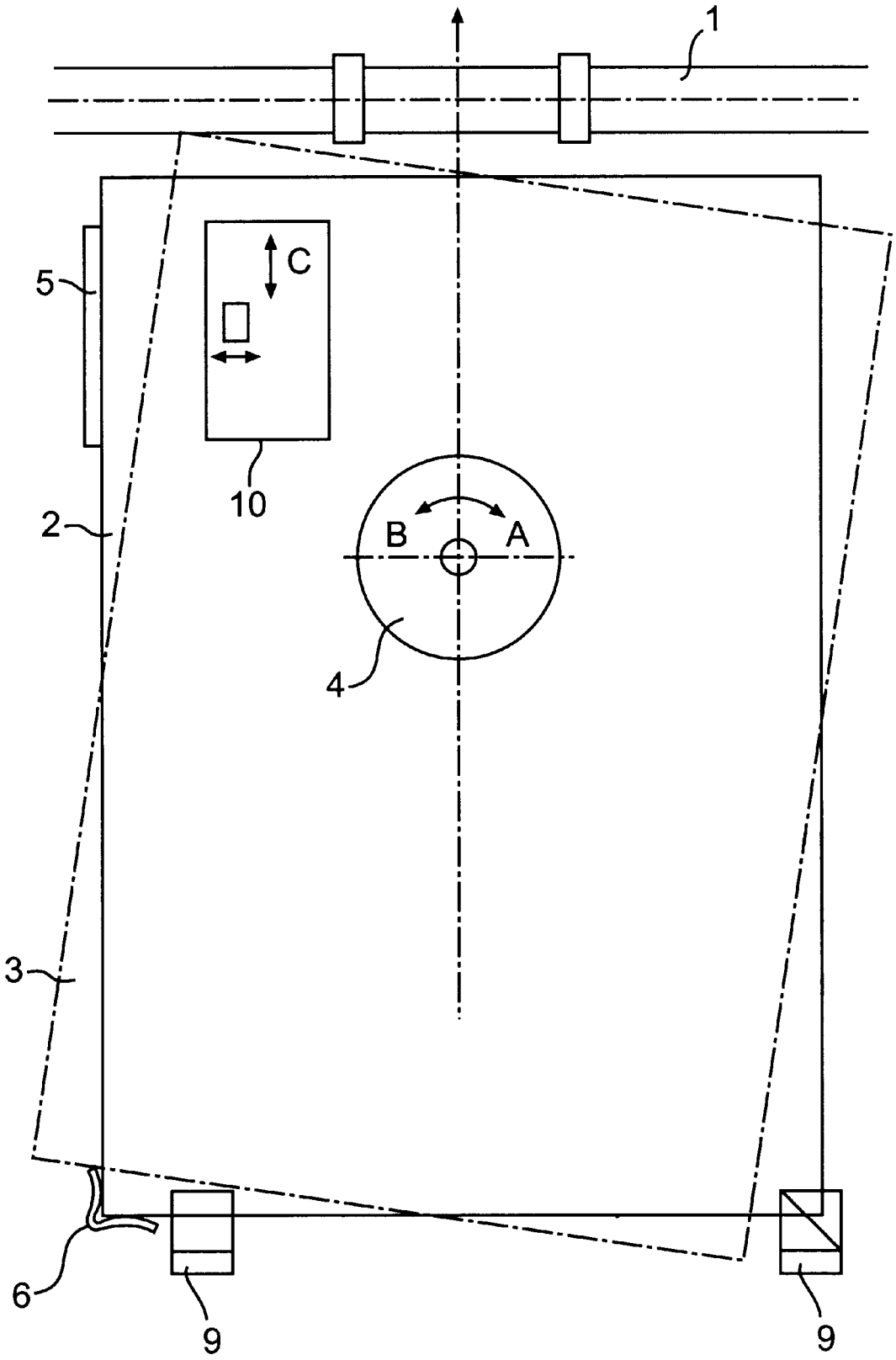
FIG. 1 shows a first embodiment with a sheet feeder with a rotary plate and an aligning and conveying device and a stop for the alignment of the sheet.

FIG. 1 shows a stack 2 of sheets. The top sheet 3 is in contact with rotary plate 4 when this is lowered. Rotary plate 4 causes a force to act on top sheet 3 and this force is sufficient for sheet 3 to be turned by rotary plate 4.

When top sheet 3 is turned in direction A with the help of rotary plate 4, the corners of top sheet 3 must move over corner separators 6. Turning is necessary only to the extent that a portion of the sheets below the top sheet 3 is no longer covered by top sheet 3 and is thus exposed.

At least one clamping finger 9 can be applied to these exposed surfaces. Clamping finger 9 is arranged so it can be pivoted away in the immediate vicinity of stack 2 of sheets. After top sheet 3 has been turned, clamping finger 9 is pivoted to the exposed area of the second sheet from the top.

Clamping finger 9 holds the second sheet from the top and the sheets below that on stack 2. This guarantees that only top sheet 3 can be moved further. Top sheet 3 is then turned back again in direction B by rotary plate 4 until it comes to lie approximately exactly in the direction of sheet feed again. Sheet 3 which has been turned back slips in turning over pointed clamping fingers 9 and corner separator 6 which hold the rest of the stack.

When top sheet 3 then turns back to its starting position, this sheet 3 again covers, at least partially, the sheets below top sheet 3 and the previously applied clamping fingers 9.

Figure 2:
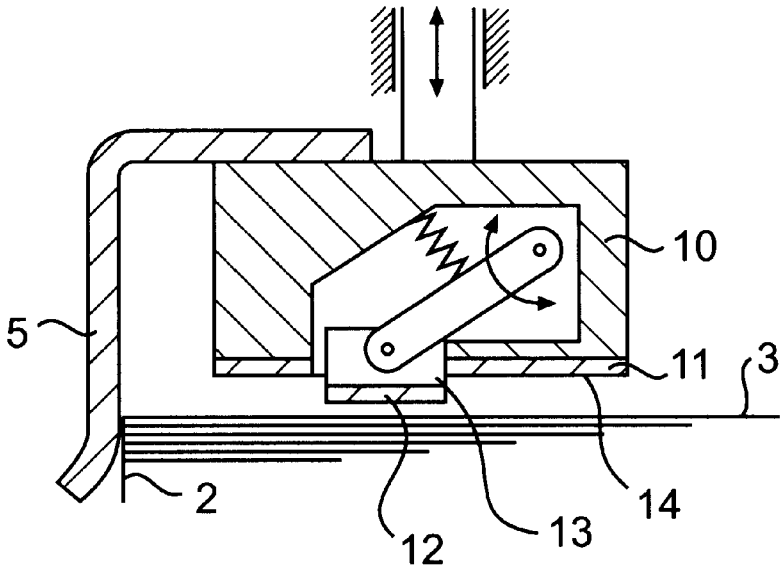
FIG. 2 shows the device of the first embodiment for lateral alignment and continued conveyance of the sheet.

As mentioned above, after sheet 3 has again been turned by rotary plate 4 back in direction B to approximately the same starting position as that occupied before being turned, an aligning device 10, which is also arranged above top sheet 3, grips top sheet 3, which has been turned back, and lifts rotary plate 4 (FIG. 2).

This aligning device 10 has an aligning foot 13 that comes into contact with the surface of top sheet 3 and exerts a force on top sheet 3, causing top sheet 3 to move toward a stop 5.

After sheet 3 has reached side stop 5, it is aligned. In addition to aligning foot 13, a conveyor foot 11 is also provided. This conveyor foot 11 moves the aligned sheet. Conveyor foot 11 conveys the top sheet into a continued conveyance device 1 that supplies aligned sheet 3 to the printing machine.

FIG. 2 shows a side view of the device for aligning and further conveying top sheet 3.

In lateral alignment with device 10, aligning foot 13 with its friction lining 12 contacts the surface of top sheet 3 and conveys the sheet to stop 5 until sheet 3 comes to rest there.

Friction lining 12 is designed so that sheet 3 reaching stop 5 is not moved by aligning foot 13 further toward stop 5 in the lateral alignment, but instead aligning foot 13 may slip on the surface of sheet 3.

After the alignment of side stop 5, aligning foot 13, which is still exerting pressure on top sheet 3, moves in the direction of sheet feed, so that top sheet 3 can be pulled off stack 2 and sent to the printing machine. Preferably the entire friction surface 14 of conveyor foot 11 and friction surface 12 of aligning foot 13 are used to feed sheet 3 to the printing machine.

Within the scope of the present invention, it is also possible to provide, in addition to aligning foot 13, a separate conveyor foot 11 that mvoes sheet 3 in the direction of conveyance after its lateral alignment.

Figure 3:
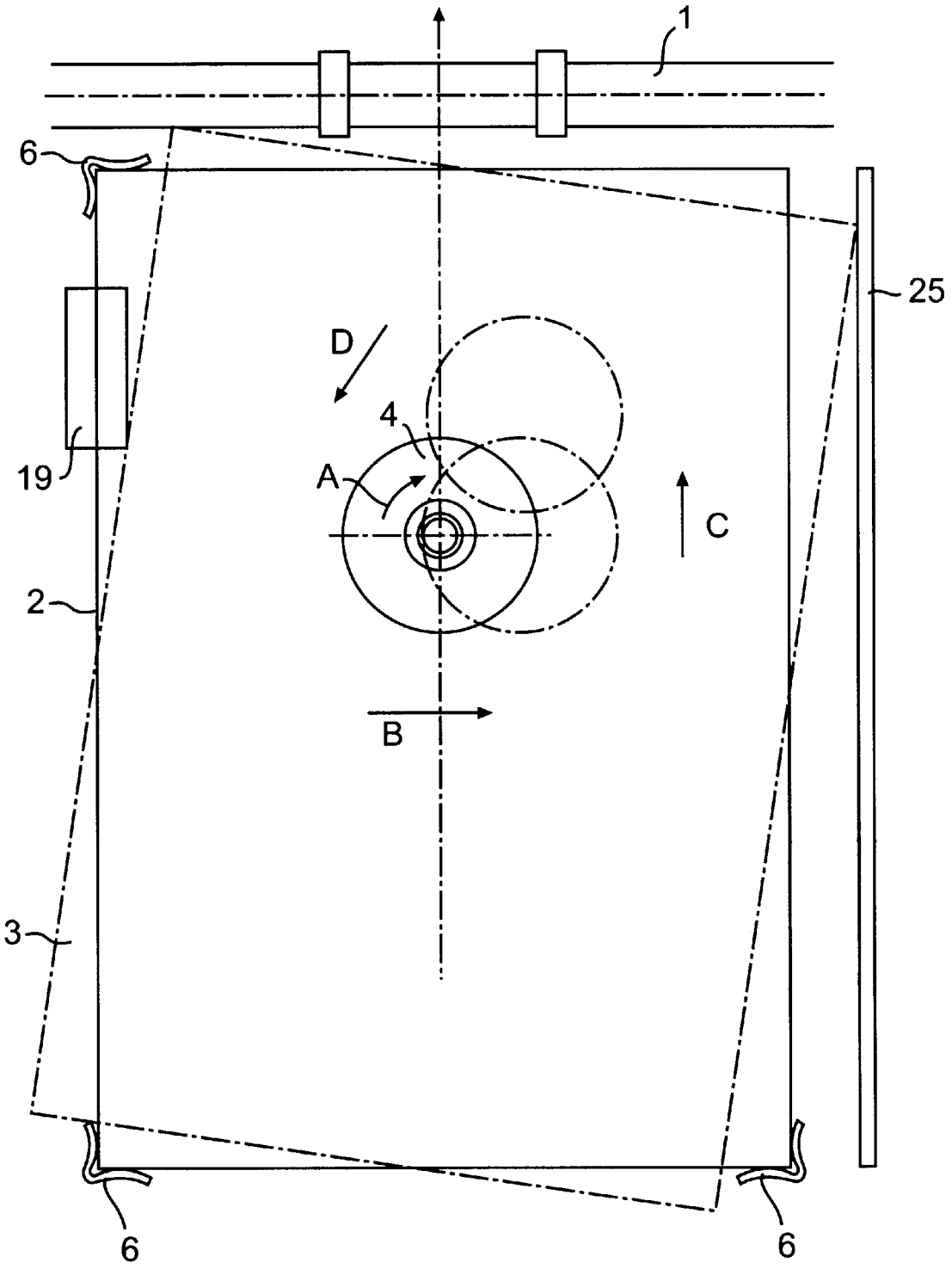
FIG. 3 shows a second embodiment of the present invention with a sheet feeder with a side stop and a rotary plate of the turning device.

FIG. 3 shows a second embodiment of the present invention in which the stack 2 of sheets is arranged along the direction of sheet feed of printing machine 1. The rotary plate 4 is provided above the stack of sheets, i.e., above top sheet 3. The function of this rotary plate 4 is to decollate top sheet 3 of stack 2 from stack 2 and send it for lateral alignment. Following lateral alignment, the top sheet is sent to the printing machine. The top sheet is decollated as required for lateral alignment by rotary plate 4 coming into contact with top sheet 3 of stack 2 of sheets. Rotary plate 4 applies a force to top sheet 3 and imparts a horizontal rotary movement to top sheet 3 in the direction of stop 25. The top sheet is then turned at an angle to the direction of sheet feed. Turning A is continued in a first direction A until one corner of the sheet is in contact with stop 25, for example. In another step, rotary plate 4 is displaced in direction B until another corner is in contact with a stop 25. As soon as the sheet side is completely in contact with stop 25, the top sheet of the stack is aligned and can be sent in direction C to the printing machine by displacement of the rotary plate.

By turning the sheet in direction A, the sheet is at an angle to the direction of sheet feed and exposes a partial area of sheet 3 which is second from the top. A clamping finger 19 is provided to clamp the sheet second from the top and the sheets below that in the area exposed by the top sheet. To prevent unwanted turning of multiple sheets, corner separators 6 are provided at the corners of the stack of sheets. When turning the top sheet in directions A and B, the corners of top sheet 3, for which corner separators 6 are provided, must move past these corner separators.

After the sheet has been fed to printing machine 1 by rotary plate 4 by turning the rotary plate in direction C, rotary plate 4 lifts up from the stack and moves back in direction D into its starting position. The next lateral alignment takes place in the manner described above after clamping finger 19 is pivoted away from stack 2 again.

Figure 4:
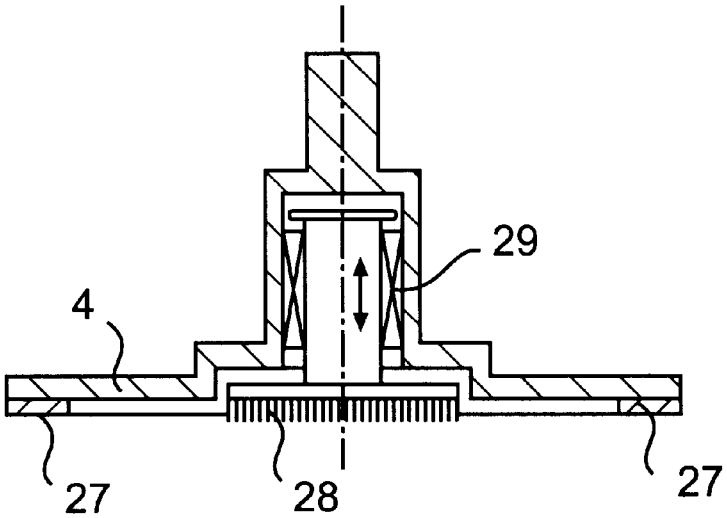
FIG. 4 shows the rotary plate of the second embodiment.

FIG. 4 illustrates an embodiment of a turning device, in particular an embodiment of rotary plate 4. The rotary plate has friction linings 27 on the bottom. The function of these friction linings 27 is to securely hold the sheet at its top side so that a motion executed by the rotary plate can be transmitted to sheet 3. When sheet 3 comes into contact with stop 25 at one corner or the other, then the second lining 28, which is designed as a brush lining 28 and integrated into rotary plate 4, comes into play. To do so, a linear bearing 29 is provided and brings brush lining 8 onto the surface of sheet 3 to be turned and thus greatly reduces the adhesive friction between rotary plate 4 and the top side of sheet 3. In this position, rotary plate 4 can continue to move in the same direction without top sheet 3, which is in contact with stop 5 for lateral alignment, moving with it. Because of brush lining 28, rotary plate 4 slips over the paper.

When sheet 3 is conveyed in another direction, friction lining 27 which is applied to rotary plate 4 comes into play again completely and brush plate 28 in rotary plate 4 is withdrawn into the interior of the turning device.

Figure 5:
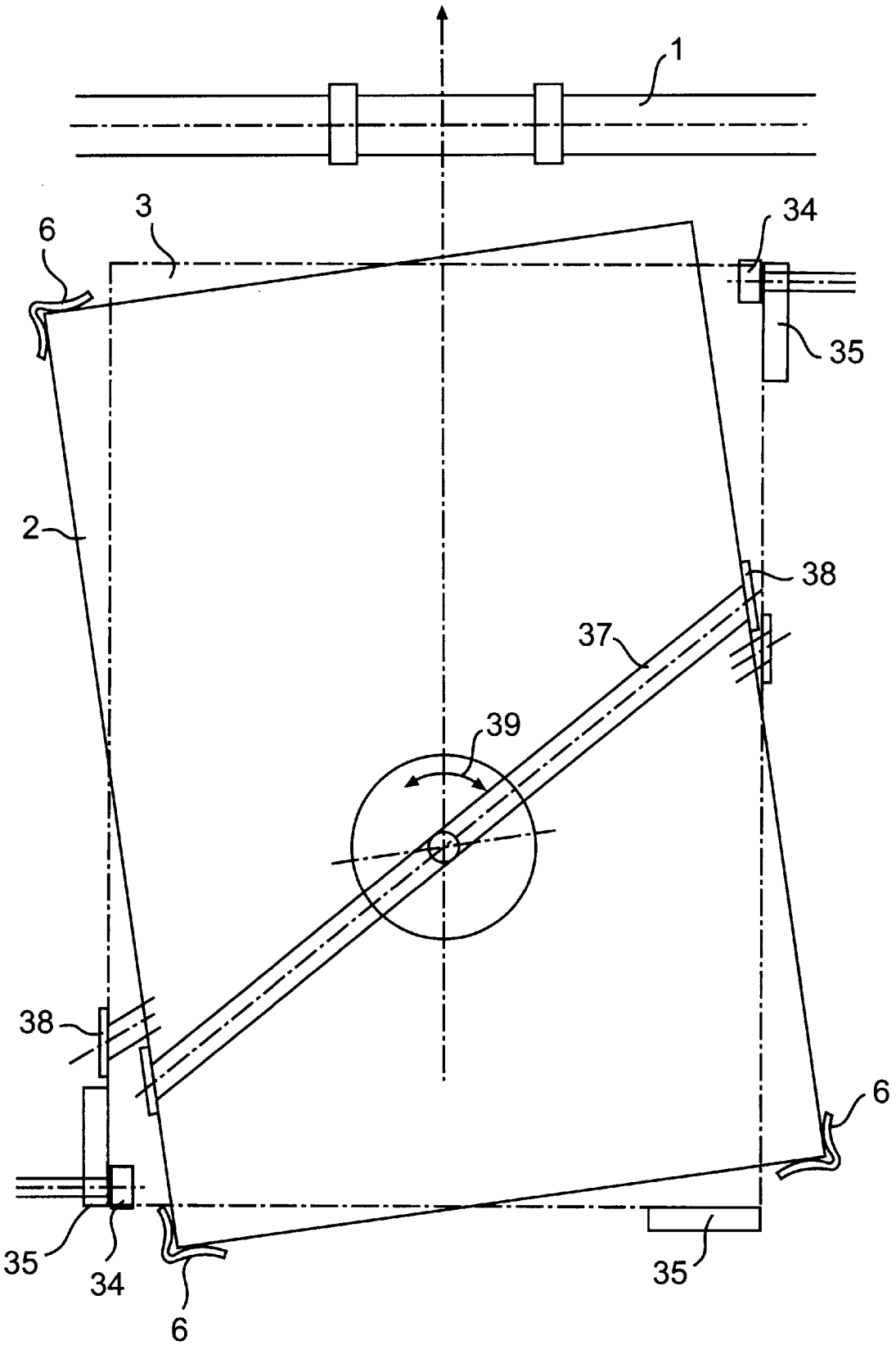
FIG. 5 shows a top view of the inclined sheet feeder of a third embodiment of the present invention.

FIG. 5 shows a third embodiment of the present invention wherein the stack 2 of sheets is arranged at an angle of 5° to 10° to the direction of sheet feed of printing machine 1. A rotary plate 39 is provided above the stack of sheets, i.e., above top sheet 3. The function of this rotary plate 39 is to decollate the top sheet 3 of stack 2 from stack 2 and feed it to printing machine 1. Decollating is accomplished by rotary plate 39 coming in contact with top sheet 3 of stack 2 of sheets. Rotary plate 39 applies a force to top sheet 3 and imparts a horizontal rotary movement to top sheet 3 in the direction of stops 35 and brings sheet 3 to rest against stops 35.

In an advantageous manner, the angle of rotation is set so that it is usually wider than the required angle of rotation of the sheet. When top sheet 3 has reached stop 35, the rotary plate therefore rotates somewhat further. The friction surface of rotary plate 39 and the pressure of rotary plate 39 on top sheet 3 are set so that sheet 3 cannot be rotated any further by the rotary plate when it comes to rest against stop 35. Instead at this moment the rotary plate slips on top sheet 3. Sheet 3 aligned in this way is placed with its front edge into conveyor rolls 34. Conveyor rolls 34 convey aligned sheet 3 into printing machine 1 in the direction of sheet feed.

It may happen that not only is top sheet 3 rotated by the action of rotary plate 39 but also the sheet(s) directly below top sheet 3 is/are turned, which is not desirable. Slides 38, which are connected to rotary plate 39 by a cross arm 37, ensure that the inadvertently displaced sheets are returned to stack 2 when rotary plate 9 is turned back. The inadvertently displaced sheets that are returned are positioned again accurately on stack 2. This operation is supported by corner separators 6. Another decollating operation then takes place with the current top sheet 3 in the same way as described above.

Figure 6:
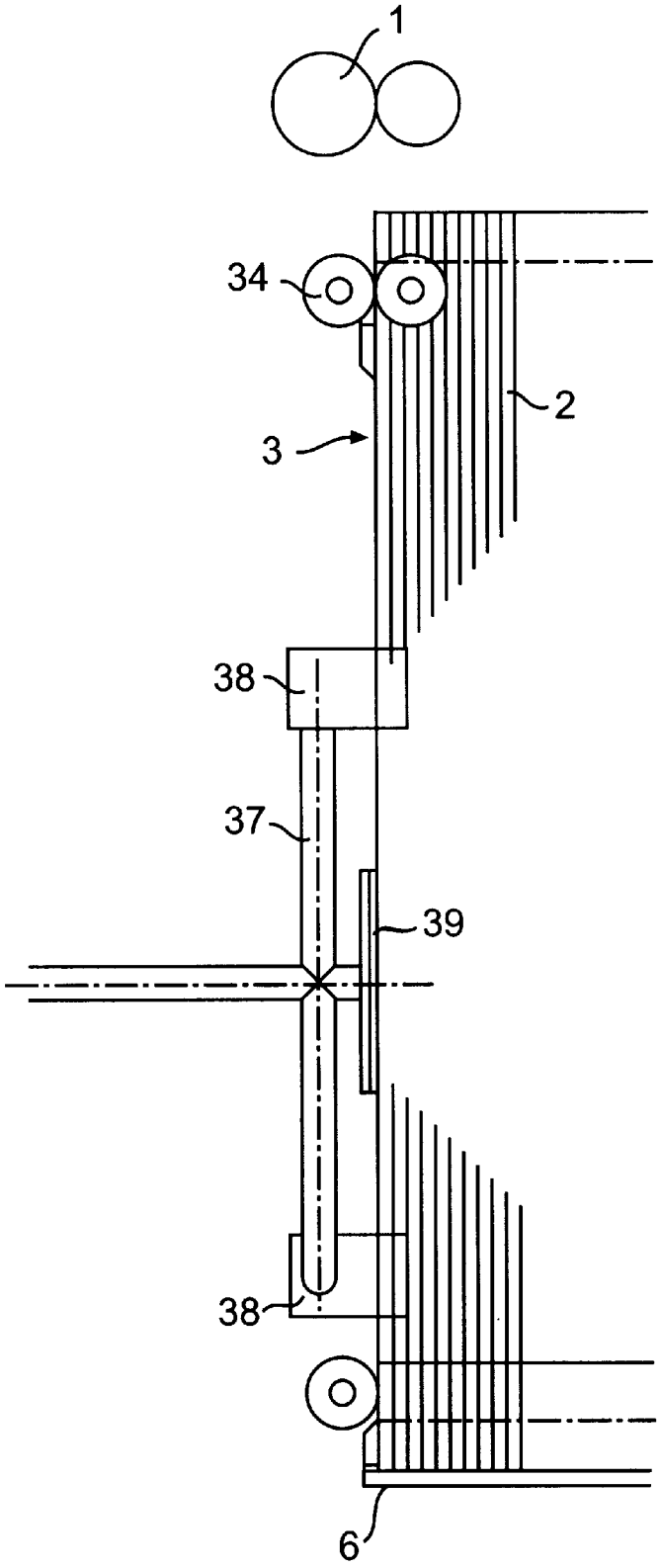
FIG. 6 shows a side view of the sheet feeder stack of the third embodiment of the present invention.

FIG. 6 shows a side view of a sheet feed stack 2. Top sheet 3 of stack 2 which is aligned in the direction of sheet feed using rotary plate 39 is fed to conveyor rolls 34, which convey the sheet 3 into printing machine 1. The slides mounted on rotary plate 39 by means of cross arm 37 ensure that the exposed, inadvertently turned sheets below the top sheet are correctly returned to stack 2. Corner separators 6 play a supporting role here.

What is claimed is:

1. A printing machine for printing sheets comprising:

a sheet feeder for feeding sheets from a stack;

a rotary plate disposed above the stack, rotatable relative to the stack;

the rotary plate being adapted for decollating a top sheet on the stack by turning the top sheet in a direction of rotation of the plate to expose a portion of a second sheet on the stack under the top sheet and then turning the top sheet back in an opposite direction of rotation; and the sheet feeder having at least one pivotable clamping finger adapted to pivot to a position for contacting the second sheet after the rotary plate has turned the top sheet.

2. The printing machine as recited in claim 1 wherein the rotary plate can be moved horizontally and vertically.

3. The printing machine as recited in claim 1 further comprising an alignment device for providing lateral alignment of the top sheet.

4. The printing machine as recited in claim 1 wherein the clamping finger is tapered.

5. A printing machine for printing sheets comprising:

a sheet feeder for feeding sheets from a stack;

a rotary plate disposed above the stack, rotatable relative to the stack;

the rotary plate being adapted for decollating a top sheet on the stack by turning the top sheet to expose a portion of a second sheet on the stack under the top sheet;

at least one clamping finger disposed on the sheet feeder for contacting the second sheet; and an alignment device for providing lateral alignment of the top sheet, wherein the alignment device is moveable to enable feeding of the top sheet in the feed direction.

6. The printing machine as recited in claim 5 wherein alignment device includes a conveyor foot.

7. A printing machine for printing sheets comprising:

a sheet feeder for feeding sheets from a stack;

a rotary plate disposed above the stack, rotatable relative to the stack;

the rotary plate being adapted for decollating a top sheet on the stack by turning the top sheet to expose a portion of a second sheet on the stack under the top sheet;

at least one clamping finger disposed on the sheet feeder for contacting the second sheet; and an alignment device for providing lateral alignment of the top sheet, wherein the alignment device includes a conveyor foot.

8. The printing machine as recited by claim 7 further comprising a stop so that the top sheet comes to rest against the stop for lateral alignment after movement by the aligning foot.

9. A printing machine for printing sheets comprising:

a sheet feeder for feeding sheets from a stack;

a rotary plate disposed above the stack, rotatable relative to the stack;

the rotary plate being adapted for decollating a top sheet on the stack by turning the top sheet to expose a portion of a second sheet on the stack under the top sheet;

at least one clamping finger disposed on the sheet feeder for contacting the second sheet; and an alignment device for providing lateral alignment of the top sheet, wherein the alignment device includes an aligning foot and a conveying foot.

10. The printing machine as recited in claim 9 wherein the conveying foot and the aligning foot have friction linings.

11. A printing machine for printing sheets comprising:

a sheet feeder for feeding sheets from a stack;

a rotary plate disposed above the stack, rotatable relative to the stack;

the rotary plate being adapted for decollating a top sheet on the stack by turning the top sheet in one direction and then in an opposite direction of rotation;

at least one clamping finger adapted to pivot to a position for contacting the second sheet after the rotary plate has turned the top sheet in the one direction; and an alignment device for providing lateral alignment of the top sheet.

12. A printing machine for printing sheets comprising:

a sheet feeder for feeding sheets from a stack;

a rotary plate disposed above the stack, rotatable relative to the stack;

the rotary plate being adapted for decollating a top sheet on the stack of sheets by turning the top sheet in one direction and then in an opposite direction of rotation;

at least one clamping finger adapted to pivot to a position for contacting the second sheet after the rotary plate has turned the top sheet in the one direction; and at least one stop for limiting movement of the top sheet.

13. The printing machine as recited in claim 12 wherein the rotary plate has a friction surface which contacts the top sheet.

14. The printing machine as recited in claim 12 wherein the stack is arranged at an angle to a direction of conveyance of the sheets.

15. A printing machine for printing sheets comprising:

a sheet feeder for feeding sheets from a stack;

a rotary plate disposed above the stack, rotatable relative to the stack;

the rotary plate being adapted for decollating a top sheet on the stack of sheets by turning the top sheet;

a friction surface for contacting the top sheet disposed on the rotary plate; and at least one stop for limiting movement of the top sheet, wherein a friction force provided by the friction surface is adjustable by reducing the size of the friction surface.

16. A method for decollating a top sheet from a stack comprising the steps of:

turning the top sheet in a first direction to partially expose a second sheet beneath the top sheet;

placing at least on one clamping finger on the second sheet;

turning the top sheet back in a second direction; and feeding the sheet to a continued conveyance device.

17. The method as recited in claim 16 further comprising the step of aligning the top sheet against a stop with a device having an aligning foot.

18. The method as recited in claim 16 wherein the feeding step is performed by an alignment device.

* * * * *